United States Patent [19]

Beck

[11] 4,193,221

[45] Mar. 18, 1980

[54] TOY BUILDING

[75] Inventor: Hans Beck, Oberasbach, Fed. Rep. of Germany

[73] Assignee: geobra Brandstaetter GmbH & Co., KG, Zirndorf, Fed. Rep. of Germany

[21] Appl. No.: 873,328

[22] Filed: Jan. 30, 1978

[30] Foreign Application Priority Data

Feb. 2, 1977 [DE] Fed. Rep. of Germany ..... 2704204

[51] Int. Cl.[2] ..... A63H 33/06

[52] U.S. Cl. ..... 46/19; 46/21; 46/12

[58] Field of Search ..... 46/12, 13, 19, 30, 31, 46/25, 21, 20

[56] References Cited

U.S. PATENT DOCUMENTS

| | | | |
|---|---|---|---|
| 1,061,637 | 5/1913 | Schwartz | 46/19 |
| 2,407,927 | 9/1946 | Hayden | 46/19 |
| 2,931,129 | 4/1960 | Boniface | 46/19 |
| 2,968,118 | 1/1961 | Paulson | 46/12 |
| 3,380,188 | 4/1968 | Baudoux | 46/19 |

*Primary Examiner*—Louis G. Mancene
*Assistant Examiner*—Michael J. Foycik, Jr.
*Attorney, Agent, or Firm*—Frank J. Jordan

[57] ABSTRACT

A toy building set for constructing a toy building includes a plurality of wall plates having anchoring elements and a plurality of connecting members having recesses for receiving the anchoring elements, the recesses having clamping bars extending from opposed walls in the recess to clampingly engage opposite sides of the anchoring elements. Roof elements and other building parts are provided to complete the construction of the toy building.

28 Claims, 11 Drawing Figures

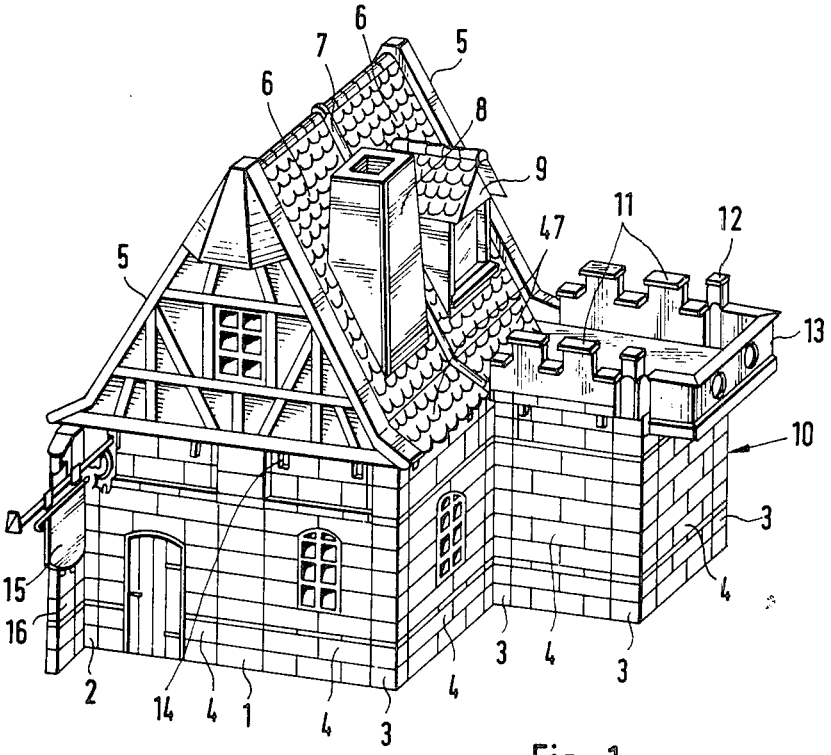
Fig. 1
Fig. 2
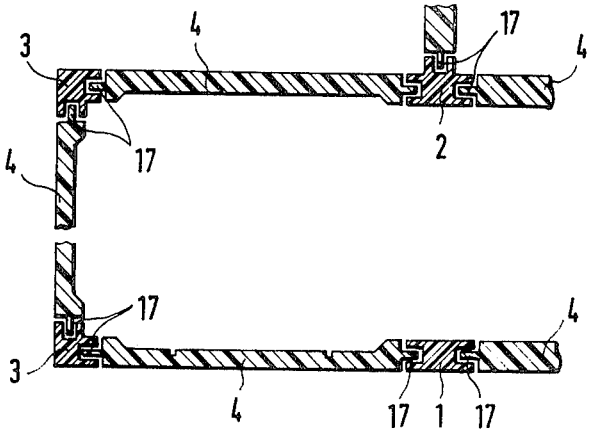

TOY BUILDING

BACKGROUND OF THE INVENTION

This invention relates to toy buildings and provides for the erection of buildings out of construction elements which are capable of being mated together and constructed in a modular system. The toy building includes wall plates corresponding to one front wall segment which may added on at least along their longitudinal edges by column-shaped connecting elements and which are provided with longitudinal recess for receiving the longitudinal edges of the wall plates, the longitudinal recesses being staggered at angles of 90° or 180°. This arrangement makes it possible to erect various types and arrangements of buildings and to take them apart again.

Accordingly, it is an object of the present invention to simplify toy building elements in order to simplify their manufacture and lower their cost. Furthermore, easier handling will make it possible for the toy to be used, particularly by small children who do not posses great manual dexterity.

In order to achieve the aforementioned objectives, the present invention encompasses in a toy building of the above described type, that the side edges and/or the top edges of the wall plates are provided with anchoring elements which may be clampingly secured within longitudinal recesses in the connecting elements or in the longitudinal recesses of the lower edge of the wall plate respectively, by furnishing the recesses with clamping bars which engage alternatingly oppositely disposed sides of the anchoring elements.

The clamping bars cause a slight distortion of the wall plates, but due to their elasticity, provide a secure clamping. Handling is extremely simple because wall plates and connecting elements are simply manually pushed into each other. The bending of the anchoring elements caused by the clamping bars furthermore has the advantage that tolerances caused by the manufacturing methods of injection molding may be balanced by such bending effects so that a lasting clamping results which is not vitiated by constant use. In order to prevent too large bending effects, the present invention provides furthermore that the longitudinal recesses are divided by crossbars and the anchoring elements are divided by notches so that single segments result. Thus the bending is apportioned to individual segments so that for several longitudinal recesses, the clamping bars need be present only in the uppermost and in the lowest longitudinal recess. In such a case the arrangement of the clamping bars is preferably chosen so that in the uppermost and in the lowest longitudinal recess a turn to a reverse orientation occurs. The various parts may be made of a plastic material.

In another embodiment of the invention, notches are provided in the upper edge of the wall plate for the suspension of accessory parts. Thus, accessories, for example signs for inns or lanterns may be suspended after the addition of an upper story. These notches are particularly appropriate for the suspension of ceiling plates provided with mounting means at one side or at two oppositely disposed sides.

The breadth of the ceiling plates corresponds to one module and its length may amount to half or whole module units. They serve not only for the building of intervals between two stories but also for the construction of simulated defense battlements. In order to be able to produce a complete inner ceiling even for larger buildings the present invention provides for a stepwise construction of the lateral edges of the ceiling plates so that the surface of a girder mountable between two ceiling plates extends flush between the plates.

The simplest design for the mounting attachments is an L-shaped connection bent downwardly. In order to obtain also a shoring to the brickwork when ceiling plates are provided at one side only with mounting attachements, the invention provides that the mounting attachments are formed with inverted U-shaped forks, open at their bottom, with the inner leg of the fork being longer than the outer one.

In order to fill the notches when not in use, the invention provides for blank attachment elements fitted onto the notches.

According to an additional feature of the invention, roof elements are provided, as the case may be, with apertures, the roof elements being capable of engaging each other. These roof elements are formed in such a manner that identical roof elements are capable of being engaged along their roof ridges.

This embodiment has the advantage that the number of the parts to be manufactured and consequently the number of the needed molds is reduced, a fact which leads to a lowering of the cost of the toy.

In order to make it possible to combine roof elements for larger roofs, the invention provides that the roof elements may mate their lateral edges by strip-shaped roof-connectors or that they mate with recesses arranged along the side edges of the gable walls, the recesses being disposed on the rear of the gable walls. In this case the under edge of the gable wall may be provided with longitudinal recesses for accepting the anchoring elements of the upper edges of the wall plates.

The clamping of the lateral edges of the roof elements by the roof connectors may be executed exactly like the connection between the wall plates and the connecting elements, in other words by clamping bars which alternatingly mesh on both sides of the edges.

Two roof elements may be connected at the ridge of the roof in such a manner that, according to the invention, the roof element on one-half of the ridge edge supports simulated ridge bricks. Within the area of its corners at the side of the ridge on its inner side are provided two projections, the projections being vertical or perpendicular with reference to the plane of the roof and parallel to the lateral edges corresponding to the pitch of the roof. One of these projections is provided with a hole and is located nearer to the side edge at a distance equal to the thickness of the other projection, and the other projection is provided with a lateral lug. This lug faces towards the lateral edge and corresponds in its diameter to the diameter of the hole in the other projection. This construction provides a simple connection of the roof and provides also the advantage that all roof elements are identical to each other. An inverse construction is also possible so that the projection which is at a further distance from the lateral edge is provided with a hole and the other projection is in that case provided with the lug facing away from the lateral edge.

According to another embodiment of the invention, gutters or eaves are provided which may be mounted on the upper edge of the wall plates and which protrude over the lower edge of the roof elements. That makes it possible to shape the roof corresponding to the actual technical practice where eaves or gutters are often arranged at inclinations other than that of the roofs. Furthermore, the invention provides for accessories fitting into aperatures in the roof elements, for example accessories such as chimneys, roof gables and the like.

In order to be capable of using the toy building not only for the construction of houses but also of castles or defense balustrades, the invention provides also battlements which may be mounted on the upper edge of the wall plates. The battlements may be connected to each other by mating their lateral edges with clamping elements of an equilateral and quadrilateral connecting pillar. The quadrilateral construction of the connecting pillar has the advantage that only one kind of connecting pillar has to be manufactured. If, as provided by the invention, the clamping elements form a longitudinal groove, open either upwards or downwards, it is possible to push the connecting pillars onto the battlements after the erection of the battlements.

Furthermore, the invention provides a balcony suspendable into the notches of the upper edge of the wall plates, and a railing of this balcony may be pushed onto a ceiling plate which may be provided with a mounting extension on one side only.

The surface of the wall plates may provided with a relief-shaped reproduction of building stones, the size and shape of which may be varied in accordance with design of the planned toy building. Furthermore, the wall plates may have apertures for the introduction of windows, bullseye glasses, fences, doors, and the like. It is also possible to prepare a wall plate having a double modular size which looks like a portal of a castle and furnished with the corresponding surrounding fieldstones.

Considering that the toy buildings made according to the invention will have to be populated by toy figures, an open wall-element may be provided consisting of a frame with anchoring bars. This method guarantees the stability of the building and makes it also possible to stage realistic games.

In order to build complete framework houses or in order to allow a mixed method of building houses consisting simulation partly of framework and partly of stone, the invention provides that some wall plates which form, for instance, whole gable walls are prepared as timber framework plates. If it is desired to build complete timber or framework houses without using the esthetically troubling connecting elements which are like masonry work, then the invention provides connecting elements which are formed like framework. Accordingly, it is possible to build larger timber or framework houses by combining framework plates with connecting elements with timber or framework plates without connecting elements, in other words with plates furnished only with the anchoring elements which act as counter-connecting elements. It is also possible to connect timberwork with brickwork when, for instance, a building abuts a town wall.

Due to the fact that bi-colored injection moldings are very expensive and that the beams of the timberwork should have another color than the wall panels, the invention provides that the timberwork elements consist of two parts. One part represents only the timberwork encompassing the beam construction and the other part is a wall plate capable of being inserted on the inner side of the first part. In order to imitate framework houses as closely as possible, the invention provides that the beams fit into longitudinal recesses arranged in the wall plate, the depth of the recesses corresponding to the thickness of the beams. Thus such a model is very similar to an actual building. The framework and the wall plates are connected by spring or clamping action according to the invention. By using this framework, separated from the wall plate, it is possible to enter the interior of a building. Furthermore, it is also possible to build by this method barns which consist only of the carrying framework-and-beam construction.

SUMMARY OF THE INVENTION

A toy building set for constructing a toy building comprising a plurality of wall plates each having lateral edge portions, the wall plates forming sections of the outer wall of the toy building. A plurality of connecting members are provided each having a plurality of recesses for receiving the lateral edge portions of the wall plates, the recesses being defined at least partially by opposed recess walls. At least some of the opposed recess walls having clamping bars extending from the opposed recess walls to clampingly engage opposite sides of the lateral edge portions. Roof elements and other building parts are provided to complete the construction of the toy building.

Other features which are considered characteristic of the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and operation of the invention, however, together with additional objects and advantages thereof will be best understood from the following description of specific embodiments when read in connection with the accompanying drawings.

BRIEF DESCRIPTION OF THE DRAWINGS

FIG. 1 is a perspective view of a building in the form of a house according to one embodiment of the present invention.

FIG. 2 is a partial section of a part of the building.

DESCRIPTION OF THE PREFERRED EMBODIMENTS

Figure 3:
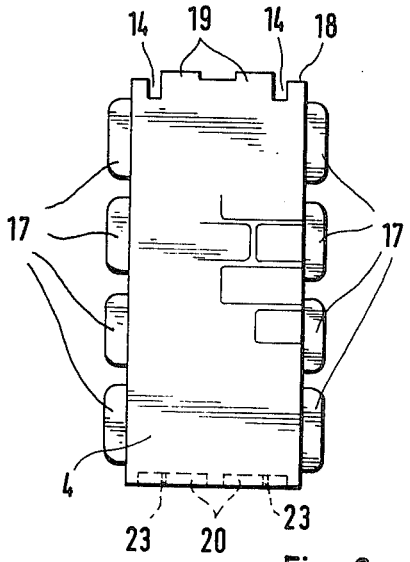
FIG. 3 is a view of a wall plate according to the invention.

Referring to the drawings, the ground floor of the house shown in FIG. 1 consists of wall-elements 4 connected by connecting elements 1, 2 and 3. The garret story is formed by two gable walls 5, roof elements 6, roof connectors 7, a chimney 8 inserted in an aperture in one of the roof element 6, and a roof gable 9. An annex 10 is crowned by battlements 11 and two connecting pillars 12, and a balcony 13 is suspended on the front side. The upper edges of the wall plates 4 are provided with notches 14 on one of which an inn-sign 15 is suspended. A strut pillar 16 is provided at the left front edge. The connecting elements may be formed as corner connectors 3, as continuous connectors 1, or as triple T-connectors 2, all as shown in FIG. 2. A quadruple connector or an element serving as an end piece having recesses on one side only may also be used.

The wall plate 4 as shown in FIG. 3 has on each of its lateral edges four single anchoring elements 17 having rounded-off edges and on its upper edge, two symmetrically arranged segments 18 and also two symmetrically arranged anchoring elements 19. A fieldstone profile may be used on the front as partially indicated in FIG. 3. Two longitudinal recesses 20 corresponding to the anchoring elements 19 are formed on the bottom edge of the wall plate 4.

Figure 4:
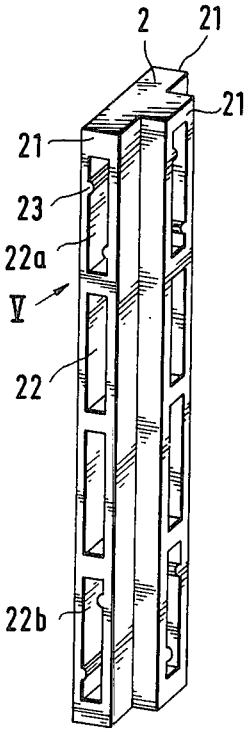
FIG. 4 is a perspective view of a T-shaped connecting element.
Figure 5:
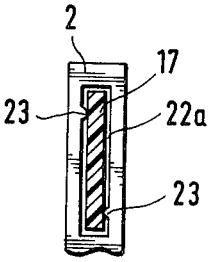
FIG. 5 is a detail view showing a portion of the connecting element of FIG. 4 looking in the direction of arrow V in FIG. 4.

The connecting element 2 in FIG. 4 has on each of its edges four longitudinal recesses 22 which correspond to the anchoring elements 17 in size and shape. Two clamping bars 23 are each integrally shaped on the walls of the upper longitudinal recess 22*a* and on the walls of the lower longitudinal recess 22*b* as shown in detail in FIG. 5. The clamping bars 23 which grip alternatingly both sides of the anchoring elements 17 are arranged in the longitudinal recesses 22*a* and 22*b* as mirror images. The longitudinal recesses 20 in the lower edge of the wall plate 4 also contain such clamping bars 23.

Figure 6:
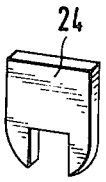
FIG. 6 is a blind part which may be used in the construction of the building.
Figure 8:
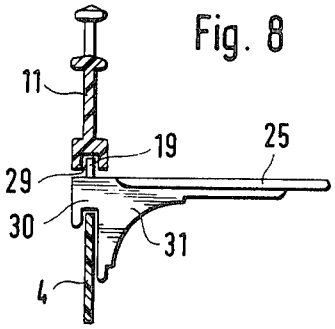
FIG. 8 is a section through a wall plate and also showing a portion of the added battlement and a mounted ceiling plate.

Blank suspending parts 24 (see FIG. 6) may be fitted into the gaps 14 of the upper edge of the wall plate 4, but likewise also ceiling plates 25 as shown in FIG. 8, as will be further described.

Figure 7:
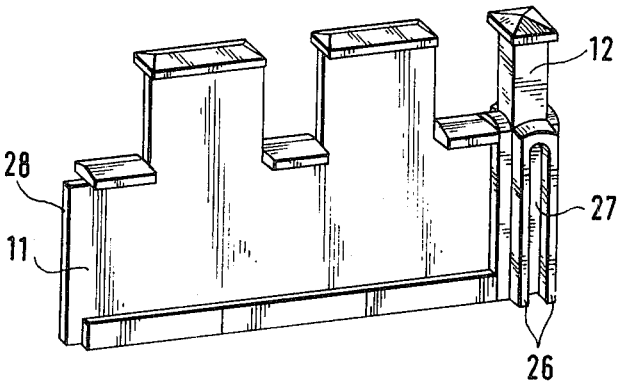
FIG. 7 is a partial view of the battlement and also showing a connecting pillar.

The connecting pillar 12 (see FIG. 7) has on all four lateral sides two clamping bars 26 each, which are closed at their top and which form a longitudinal recess 27 therebetween. The breadth of the longitudinal recess 27 corresponds to the thickness of the battlement 11, so that the lateral edges 28 of the battlement 11 are capable of being clamped between the clamping bars 26. The battlement 11 contains on its underside also a longitudinal recess 29 which can be engaged by the anchoring elements 19 of the upper edge 18 of the wall plate 4.

A mounting extension 30 of a ceiling plate 25 is mounted in the gap 14 of the wall plate 4 (see FIG. 8). The mounting extension 30 is U-shaped and the inner leg 31 is longer than the outer leg, so that the inner leg 31 serves as a strut with regard to the wall plate 4.

Figure 10:
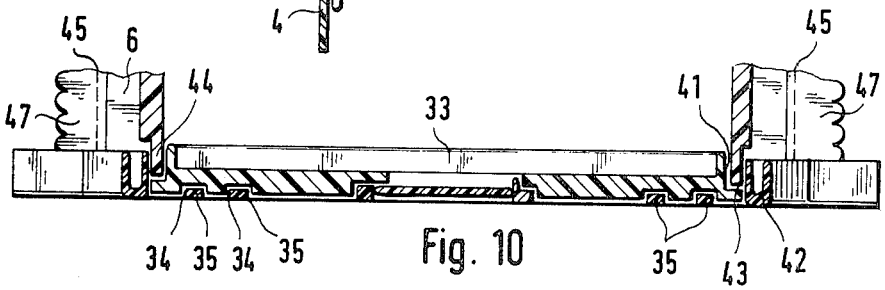
FIG. 10 is a sectional view taken along line X—X in FIG. 9.
Figure 9:
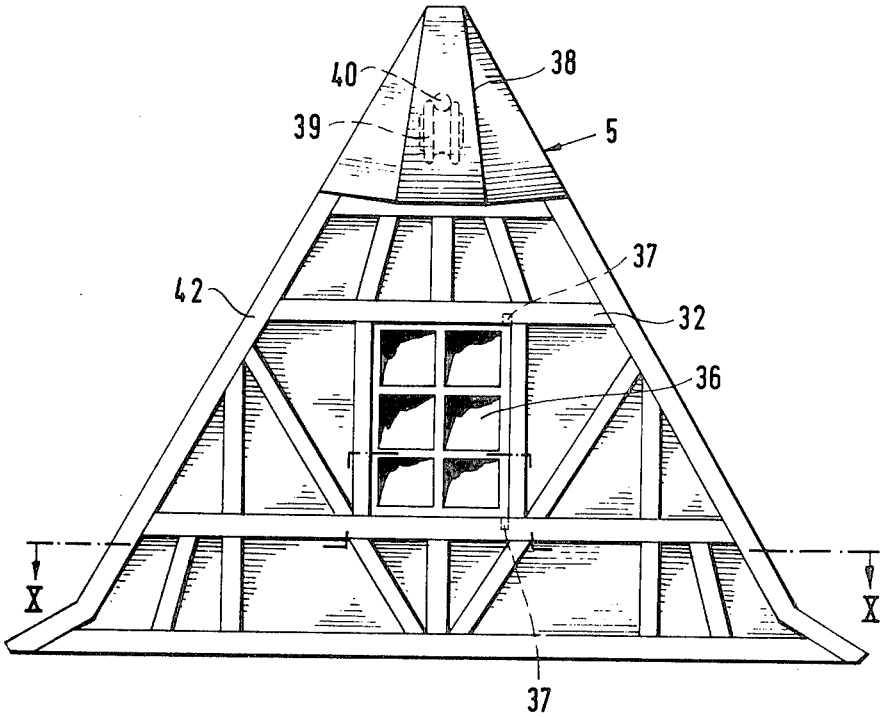
FIG. 9 is a view of the gable framework.

The gable wall 5 in FIGS. 9 and 10 consists of a framework 32 and a wall plate 33 fitted into the framework 32. Longitudinal recesses 34 are disposed in the front side of the wall plate 33 and beams 35 of the framework 32 are disposed in these recesses 34. In the center of the gable wall 5 there is arranged a window 36 which is fastened swivellably by two lugs 37 held between the wall plate 33 and the framework 32. At the apex of the gable wall 5 is arranged a protruding cap 38 behind which is arranged a hoist 39 (indicated by broken lines in FIG. 9) and a hole 40 leading through the wall plate 33.

Between the lateral edges 41 of the wall plate 33 and an outer beam 42 of the framework 32 is situated a longitudinal recess 43 into which fits the lateral edges 44 of the roof elements 6. The gutters or eaves 47 protrude over the rim 45 of the roof elements 6 (see also FIG. 1).

Figure 11:
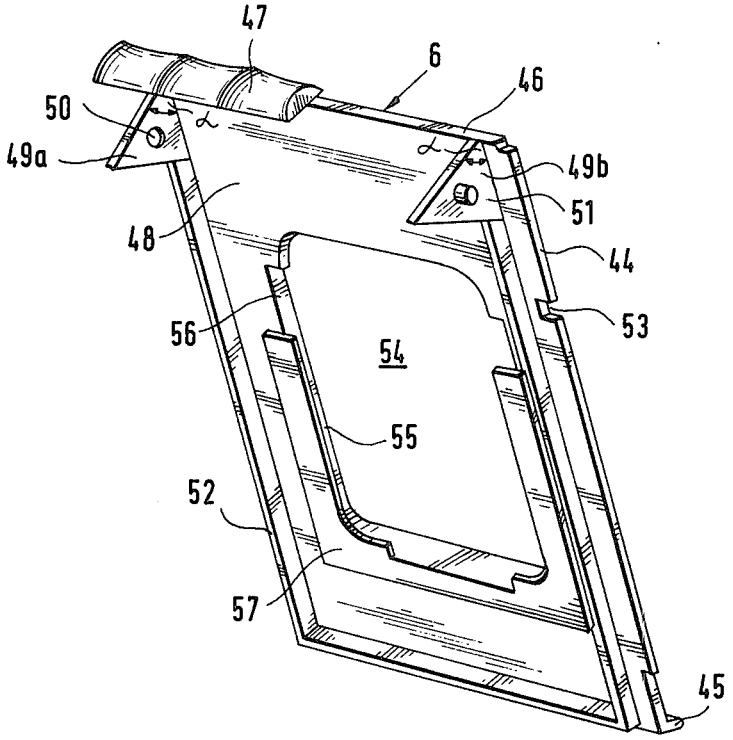
FIG. 11 is a rear view of a roof element.

The details of construction of a roof element is shown in FIG. 11. The roof element 6 carries simulated ridge bricks 47 upon one-half of its upper edge 46. Upon the inner side 48 of the roof element 6 are arranged two projections 49*a* and 49*b*. Projection 49*a* is provided with a hole at 50 and the projection 49*b* has a lug 51 facing towards the right. The diameter of the lug 51 is slightly smaller than the diameter of the hole 50. Both projections 49 are integral parts of a rib 52 respectively which exends around the roof element 6 as shown in FIG. 11. The rib 52 along with its projection 49*a* is disposed closer to the rim of the roof element 6 than does the extension 49*b* relative to its repsective rim. The difference between the distance of the projections 49*a* and 49*b* from the edge of the roof element 6 is equal to the breadth of the rib 52, thus also the breadth of the projection 49*b*. This construction permits a second identical roof element to be fitted to the first roof element at the ridge of the roof. The angle "$\alpha$" corresponds to the pitch of the roof.

An inverse construction is, of course, also possible where the projection 49*b* is furnished with the hole and the projection 49*a* contains the lug. In this case, the lug 51 in FIG. 11 would have to face towards the right side.

The lateral edge 44 is interrupted by a notch 53 which serves to establish the direction of the roof element 6 in relation to the gable wall 5. Thus, the notch 53 cooperates with a crosswall provided within the longitudinal groove 43. The roof element 6 has an opening 54 the side walls 55 of which are provided with two widenings 56. The inner side 48 of the roof element 6 is provided around the rim of the opening 54 with a stop 57. Accessories, such as the chimney 8 or the roof gable 9 (see FIG. 1) may be arranged therein.

It is thought that the invention and many of its attendant advantages will be understood from the foregoing description and that it will be apparent that various changes may be made in the form, construction, and arrangements of the parts without departing from the spirit and scope of the invention or sacrificing all of its material advantages. The form heretofore described being merely a preferred embodiment thereof.

What is claimed is:

1. A toy building set for constructing a toy building comprising a plurality of wall plates each having lateral edge portions, said lateral edge portions having anchoring elements thereon, said wall plates forming sections of the outer wall of the toy building, a plurality of connecting members each having a plurality of recesses for receiving said anchoring elements, said recesses being defined at least partially by opposed recess walls, said opposed recess walls being spaced from one another a distance greater than the thickness of said anchoring elements, at least some of said opposed recess walls having clamping bars extending from said opposed recess walls, said clamping bars being offset relative to one another such that the clamping bar on one recess wall is displaced in a non-opposed position relative to the clamping bar on the opposed recess wall, said clamping bars having terminating ends which engage said anchoring elements, said wall plates being made of a resilient material, said terminating ends of said clamping bars on said opposed recess walls being spaced from one another such that upon insertion of an anchoring element into the recess, the anchoring element is lightly distorted to thereby provide a clamping securement.

2. A toy building set for constructing a toy building according to claim 1, wherein said opposed recess walls are substantially flat longitudinal walls parallel to one another, said clamping bars comprising protrusions extending from said flat walls, each of said recess walls having at least one protrusion extending into the recess from the respective recess wall.

3. A toy building set for constructing a toy building according to claim 1, wherein said connecting member is an elongated longitudinally extending element, said opposed recess walls being generally parallel to one another and to the longitudinal axis of said connecting member, said clamping bars being elongated and extending perpendicular to the longitudinal axis of said connecting member.

4. A toy building set for constructing a toy building according to claim 1, wherein more than two recesses are provided on at least one of said connecting members such that intermediate recesses are located between spaced end recesses, said clamping bars being provided on the end recesses with the opposed recess walls of the intermediate recesses being flat and devoid of said clamping bars.

5. A toy building set for constructing a toy building according to claim 1, wherein said recesses have an opening edge, said clamping bars extending from said opening edge into said recesses.

6. A toy building set according to claim 1 wherein said wall plates are provided with upper and lower end portions, said lower end portions having means defining recesses and said upper end portions having anchoring elements, said recesses on said lower end portion being defined at least partially by opposed recess walls, and clamping bars extending from the last said opposed recess walls to clampingly engage opposite sides of the anchoring elements on the upper end portion of a like wall plate.

7. A toy building set according to claim 6 wherein said connecting members are of an elongated construction to define vertical supports for the toy building, said plurality of recesses being longitudinally spaced from one another with cross wall members separating the longitudinally spaced recesses, said anchoring elements being spaced from one another corresponding to the spacing of said recesses in said connecting members.

8. A toy building set according to claim 6 wherein said upper edge portion of said wall plate has an upper edge with slots extending inwardly from said upper edge, and accessory means suspended from said slots.

9. A toy building set according to claim 6 further comprising ceiling plates having mounting extensions on at least one side thereof.

10. A toy building set according to claim 9 wherein said ceiling plates have lateral edges with stepped portions, and a beam mountable between two of said ceiling plates and mounted in said stepped portions such that the surface of the beam is flush with said ceiling plates.

11. A toy building set according to claim 9 wherein said mounting extensions comprise generally inverted U-shaped parts having an inner and an outer leg, said inner leg being longer than said other leg.

12. A toy building set according to claim 8 further comprising blind hanger elements received in said slots in the upper edge of said wall plate for closing said slots.

13. A toy building set for constructing a toy building comprising a plurality of wall plates each having lateral edge portions, said lateral edge portions comprising anchoring elements, said wall plates forming sections of the outer wall of the toy building, a plurality of connecting members each having a plurality of recesses for receiving said anchoring elements, said recesses being defined at least partially by opposed recess walls, said opposed recess walls being spaced from one another a distance greater than the thickness of said anchoring elements, at least some of said opposed recess walls having clamping bars extending from said opposed recess walls, said clamping bars being offset relative to one another such that the clamping bar on one recess wall is displaced in a non-opposed position relative to the clamping bar on the opposed recess wall, said clamping bars having terminating ends which engage said anchoring elements, said wall plates being made of a resilient material, said terminating ends of said clamping bars on said opposed recess walls being spaced from one another such that upon insertion of an anchoring element into the recess, the anchoring element is slightly distorted to thereby provide a clamping securement to thereby clampingly engage opposite sides of said anchoring elements, said wall plates being provided with upper and lower end portions, said lower end portions having means defining further recesses and said upper end portions having further anchoring elements, said further recesses on said lower end portion being defined at least partially by opposed recess walls, clamping bars extending from the last said opposed recess walls to clampingly engage opposite sides of said further anchoring elements on the upper end portion of a like wall plate, and roof elements for said toy house, each of said roof elements having joining means for joining a plurality of roof elements to one another on said toy house.

14. A toy building set according to claim 13 wherein at least one of said roof elements has apertures for receiving appurtenances such as chimney elements, roof gables, and the like.

15. A toy building set according to claim 13 further comprising end walls on said toy building, said end walls having means at their lower edge portions defining recesses, said latter recesses having opposed recess walls, said anchoring elements in said upper end portion of said wall plates being received in said recesses on said end wall, and clamping bars extending from said opposed recess walls of at least some of said latter recesses to clampingly engage opposite sides of said anchoring elements.

16. A toy building set according to claim 15 wherein said end walls have grooves on their inner side thereof in which a lateral edge of a roof element is received.

17. A toy building set according to claim 15 wherein each of said roof elements has a top edge, and means simulating ridge tiles extending along one-half of said top edge.

18. A toy building set according to claim 15 wherein each of said roof elements has two projections extending generally perpendicularly from the general plane of the roof element, one of said projections being disposed at a distance closer to one lateral edge of the roof element than the distance that the other projection is disposed relative to the other lateral edge of the roof element, the difference in said distances being equal to the thickness of said one projection.

19. A toy building set according to claim 18 wherein one of said projections has a lateral lug and the other projection has an opening in which the lateral lug of a like roof element is received to thereby join together said roof elements.

20. A toy building set according to claim 13 wherein each of said roof elements is provided at its lower edge with an eave-simulating projection which are disposed on the upper edge portion of said wall plates.

21. A toy building set according to claim 13 further comprising battlement-simulating means mounted on said upper edge portions of said wall plates, said battlement-simulating means comprising battlement wall elements and connecting pillar elements having four sides, each of said sides having a groove adapted to receive a lateral edge of said battlement wall element.

22. A toy building set according to claim 21 wherein said grooves extend longitudinally and are closed at one longitudinal end and open at the opposite longitudinal end.

23. A toy building set according to claim 9 further comprising a balcony-simulating element mounted on slots in the upper edge of said wall plates said balcony-simulating element having a railing mounted on said ceiling plate.

24. A toy building set according to claim 6 further comprising means defining apertures in at least some of said wall plates for receiving windows, doors, and the like.

25. A toy building set according to claim 6 wherein said wall plates comprise an open frame element provided with said recesses and said lateral edge portions.

26. A toy building set according to claim 15 wherein said end wall comprises one part in the form of a wall and another part in the form of a framework having beam elements, said wall part having grooves in which said beam elements are accommodated.

27. A toy building set according to claim 26 wherein the depth of said grooves corresponds to the thickness of said beam elements.

28. A toy building set according to claim 26 further comprising means for securing said framework to said wall part.

* * * * *